US010973300B2

(12) United States Patent
Kim

(10) Patent No.: US 10,973,300 B2
(45) Date of Patent: Apr. 13, 2021

(54) AIRTIGHT COSMETIC-PENCIL CONTAINER

(71) Applicants: CTK CO., LTD, Seongnam-si (KR); Jin Woo Kim, Anyang-si (KR)

(72) Inventor: Jin Woo Kim, Anyang-si (KR)

(73) Assignee: CTK CO. LTD., Seongnam-si (KR)

( * ) Notice: Subject to any disclaimer, the term of this patent is extended or adjusted under 35 U.S.C. 154(b) by 333 days.

(21) Appl. No.: 16/089,318

(22) PCT Filed: Apr. 14, 2017

(86) PCT No.: PCT/KR2017/004040
§ 371 (c)(1),
(2) Date: Sep. 27, 2018

(87) PCT Pub. No.: WO2017/183860
PCT Pub. Date: Oct. 26, 2017

(65) Prior Publication Data

US 2020/0297096 A1 Sep. 24, 2020

(30) Foreign Application Priority Data

Apr. 18, 2016 (KR) ..... 10-2016-0046806

(51) Int. Cl.
*A45D 40/04* (2006.01)
*A45D 40/20* (2006.01)
(Continued)

(52) U.S. Cl.
CPC ..... *A45D 40/04* (2013.01); *A45D 40/205* (2013.01); *A45D 40/06* (2013.01); *A45D 40/20* (2013.01);
(Continued)

(58) Field of Classification Search
CPC ..... A45D 40/04; A45D 40/205; A45D 40/06; A45D 40/12; A45D 40/02; A45D 40/023;
(Continued)

(56) References Cited

U.S. PATENT DOCUMENTS 5,733,058 A * 3/1998 Hofmann ..... A45D 40/04 401/68
5,888,004 A * 3/1999 Bouix ..... A45D 40/04 401/68

FOREIGN PATENT DOCUMENTS

JP 2011-120843 A 6/2011
KR 10-2011-0013619 A 2/2011

* cited by examiner

*Primary Examiner* — David J Walczak
(74) *Attorney, Agent, or Firm* — John K. Park; Park Law Firm

(57) ABSTRACT

An airtight cosmetic-pencil container that is configured to extrude and retract pencil-type cosmetic content. To this end, a tube of a holder provided with a cosmetic pencil therein is hermetically and tightly assembled inside a container body, a sealing rubber of an upper cap coupled to an upper portion of a container body is hermetically and tightly assembled to the upper portion of the container body, and an expanded portion of the tube is tightly assembled to an inner surface of a coupling hole of the container body, thereby achieving excellent airtightness. Thus, when the cosmetic-pencil container is stored and carried, moisture, fragrances, and original ingredients of the cosmetic pencil are prevented from being evaporated, and outside air is prevented from being flowing into the container body, thereby preventing hardening, contamination, and deterioration of the cosmetic pencil, and preserving quality of the cosmetic pencil.

3 Claims, 6 Drawing Sheets

(51) Int. Cl.
*A45D 40/06* (2006.01)
*A45D 40/00* (2006.01)

(52) U.S. Cl.
CPC ..... *A45D 2040/0006* (2013.01); *A45D 2040/208* (2013.01); *A45D 2200/051* (2013.01); *B65D 2543/00962* (2013.01)

(58) Field of Classification Search
CPC ..... A45D 40/20; A45D 2040/0006; A45D 2040/208; A45D 2040/051; A45D 2040/0025; A45D 2040/0062; A45D 2040/20; A45D 2040/205; A45D 2200/051; B65D 2543/00962; B65D 2543/00953; B65D 2543/0005
USPC ..... 401/75, 82, 86, 88, 98, 171, 172, 173, 401/174
See application file for complete search history.

[Fig. 1]
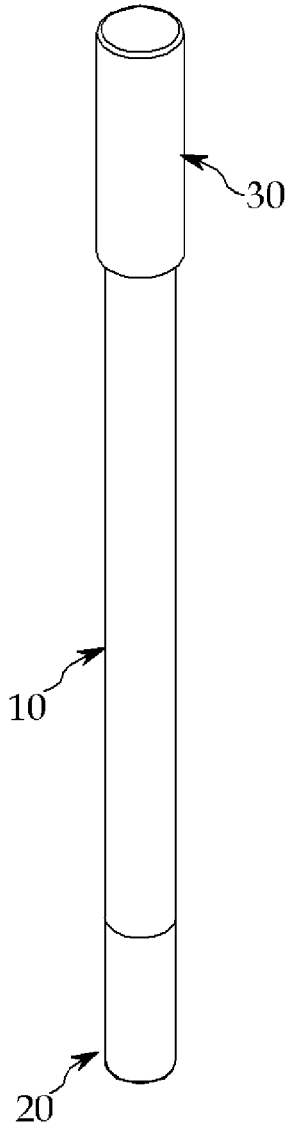

[Fig. 2]
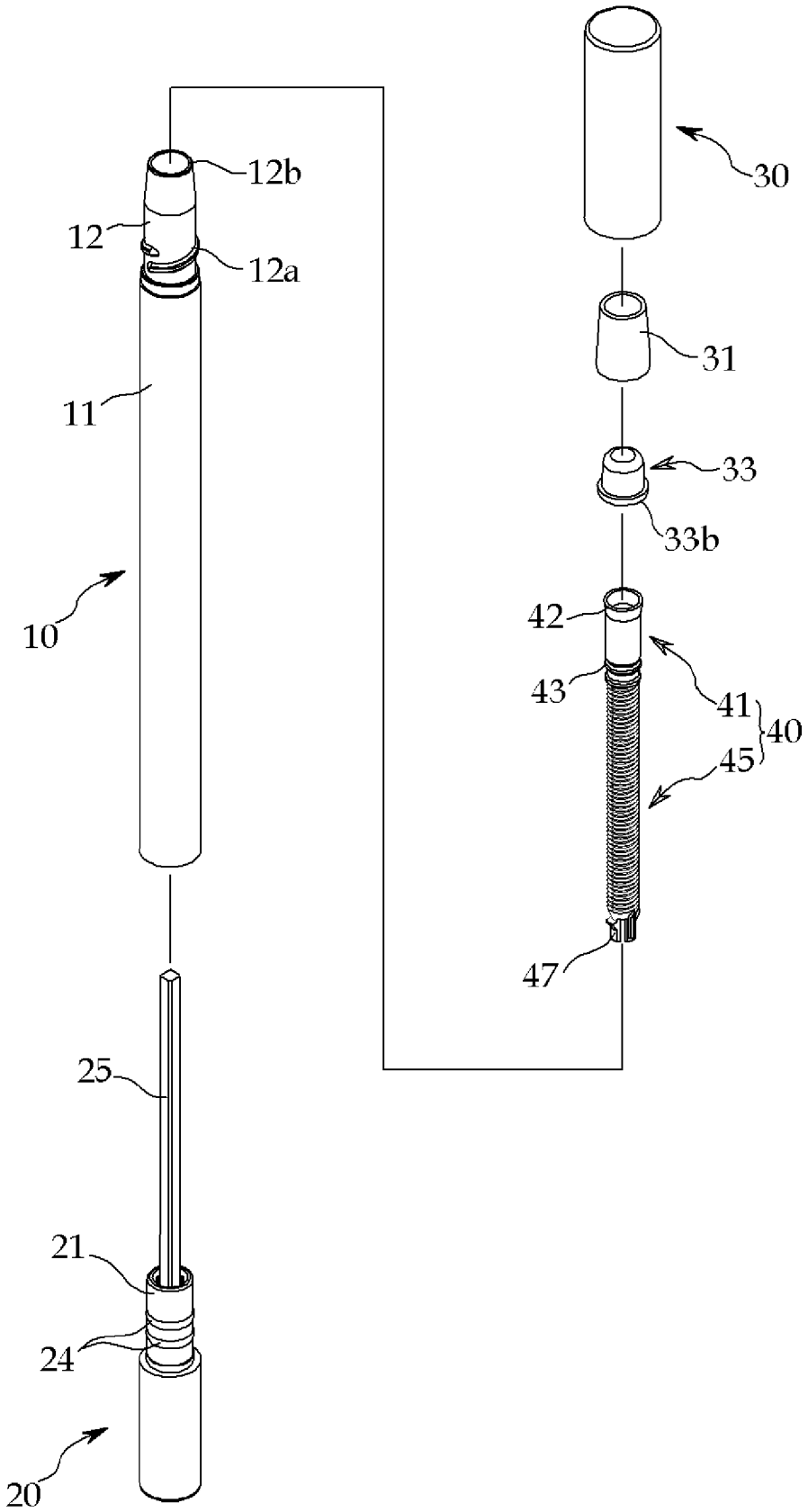

[Fig. 3]
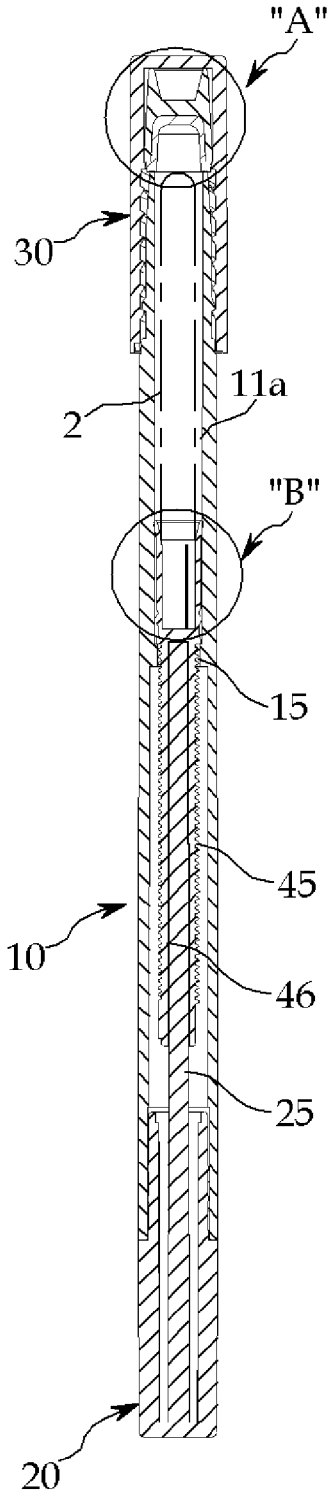

[Fig. 4]
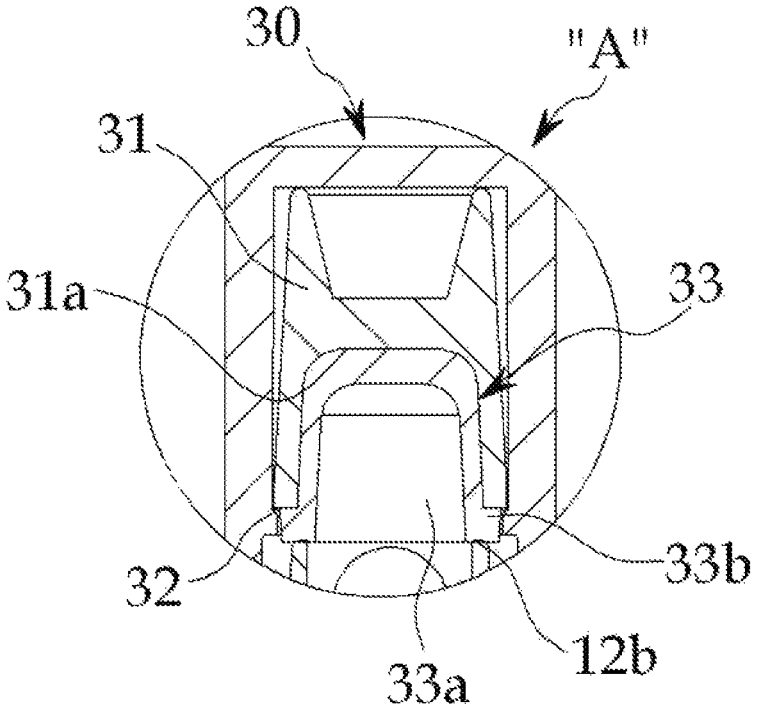
[Fig. 5]
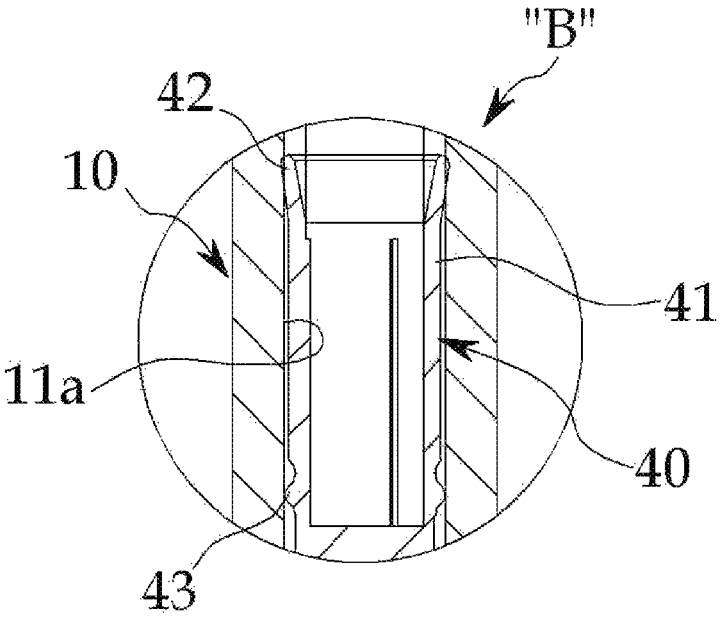

[Fig. 6]
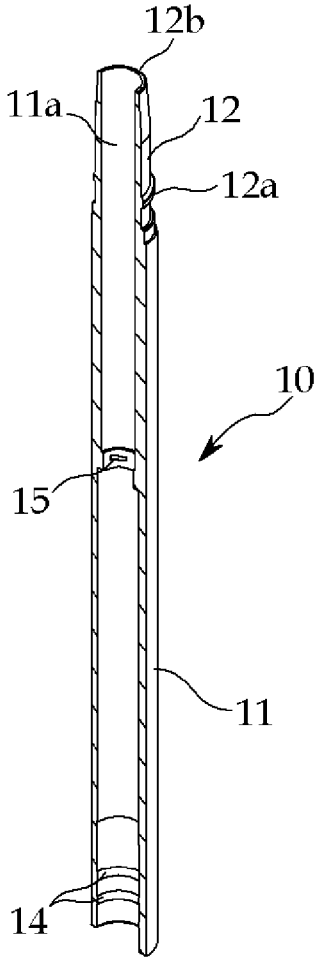

[Fig. 7]
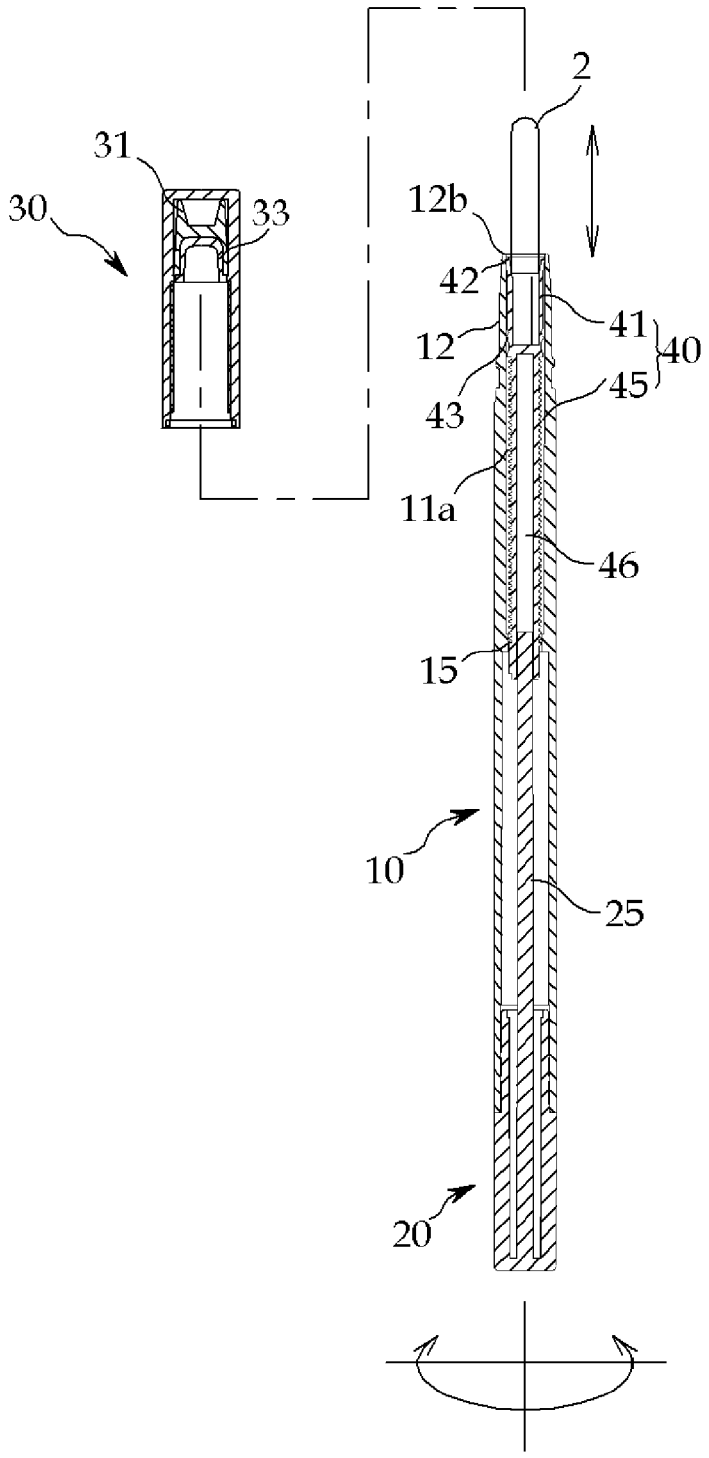

AIRTIGHT COSMETIC-PENCIL CONTAINER

TECHNICAL FIELD

The present invention relates generally to an airtight cosmetic-pencil container. More particularly, the present invention relates to an airtight cosmetic-pencil container that is configured to extrude and retract pencil-type cosmetic content, wherein a tube of a holder provided therein with a cosmetic pencil is tightly and hermetically assembled inside a container body, and a sealing rubber of an upper cap coupled to an upper end of a container body is brought into tight and hermetic contact with the upper end of the container body, whereby excellent airtightness is achieved and quality of the cosmetic pencil is preserved.

BACKGROUND ART

In general, a cosmetic-pencil container holds pencil-type cosmetics, such as eyeliner, lipstick, etc.

Such a cosmetic-pencil container is configured to extrude a cosmetic pencil upward from the inside of the container.

In other words, as disclosed in Korean Utility Model Publication No. 20-2015-4424, a holder having a cosmetic pencil (lipstick) is inserted into and coupled to a container body having a protective tube at an upper portion thereof, wherein a guide protrusion of the holder is coupled to a helical guide groove, and the holder is moved up and down by rotating the container body, such that the cosmetic pencil (lipstick) is extruded to be used.

In the case of carrying and storing the container after use, a cap is hermetically coupled to an upper portion of the container body, and a sealing member is coupled to the inside of the cap such that the sealing member is in close contact with an upper portion of the protective tube to hermetically coupled therewith.

However, since such a conventional cosmetic-pencil container has poor airtightness, external air is introduced into the interior of the container during carrying and storage, and comes into contact with the cosmetic pencil, which results in hardening of the cosmetic pencil and evaporation of its original ingredients and fragrances, thereby causing a reduction in the quality of product.

In other words, in the conventional cosmetic-pencil container, when the cap is hermetically coupled to the upper portion of the container body, a lower edge of the sealing member of the cap is in close contact with the upper portion of the protective tube, and a lower surface of the sealing member is formed to have a width equal to a thickness of an outer wall of the sealing member, thus an area of contact between the lower surface of the sealing member and the upper portion of the protective tube is small. Further, the lower surface of the sealing member is simply in close contact with the upper portion of the protective tube, but there is no pressing force acting on the lower surface of the sealing member, which leads to a reduction in adhesion force therebetween. Thus, it is difficult to ensure excellent airtightness.

In addition, when the cap is opened, external air flows into the interior of the container body from a lower portion of the holder through a gap between the protective tube and the holder, and external air inside the container body constantly comes into contact with the cosmetic pencil of the holder, which results in hardening of the cosmetic pencil and evaporation of its original ingredients and fragrances, thereby causing a reduction in the quality of product.

DOCUMENTS OF RELATED ART (Patent Document 0001) 1: Korean Utility Model Publication No. 20-2015-0004424

(Patent Document 0002) 2: Korean Utility Model Registration No. 20-0438562

(Patent Document 0003) 3: Korean Utility Model Registration No. 20-0450995

DISCLOSURE

Technical Problem

Accordingly, the present invention has been made keeping in mind the above problems occurring in the prior art, and an object of the present invention is to provide an airtight cosmetic-pencil container, wherein a tube of a holder provided with a cosmetic pencil therein is tightly and hermetically assembled inside a container body, and a sealing rubber of an upper cap coupled to an upper portion of a container body is brought into tight and hermetic contact with the upper end of the container body, whereby excellent airtightness is achieved and quality of the cosmetic pencil is preserved.

Technical Solution

In order to accomplish the above object, the present invention provides an airtight cosmetic-pencil container, including: a cylindrical container body provided with a coupling hole, and a coupling step having an upper end, with a threaded portion being formed on an outer circumferential surface of the coupling step; a lower body rotatably coupled to a lower portion of the container body; an upper cap openably coupled to the threaded portion formed on the coupling step of the container body by screw-type engagement; and a holder inserted in the container body, and provided at an upper portion thereof with a tube, into which a cosmetic pencil is inserted, and at a lower portion thereof with a screw rod spirally engaged with a screw guide portion provided inside the container body, and into which an assembly bar provided at an upper portion of the lower body is inserted, such that the screw rod is rotated up and down in conjunction with rotation of the lower body, wherein the upper cap includes an insert cap and a sealing rubber fitted into a lower recess of the insert cap, wherein the sealing rubber is provided with a cap-shaped cavity formed to be open at a lower side thereof, and a flange formed around an outer lower end of the sealing rubber and surrounding a lower end of the insert cap, such that when the upper cap is closed to the container body by screw-type engagement, a lower end of the flange of the sealing rubber fitted in the insert cap is in close and hermetic contact with an upper end of the container body, and the coupling hole of the container body is closely and elastically blocked by an expanded portion of the tube inserted into the container body, such that when the upper cap is coupled to the container body, external air is prevented from flowing into the upper cap and into the container body.

The expanded portion of the tube may be formed to gradually widen outward, such that an outer diameter of the expanded portion is larger than an inner diameter of the coupling hole of the container body.

The tube of the holder may be provided with a support protrusion protruding on a lower outer surface of the tube, and being in close contact with an inner surface of the coupling hole of the container body such that the holder is prevented from being positionally deviated when being rotated up and down.

Advantageous Effects

As described above, according to the present invention, an expanded portion formed at a tube of a holder provided with a cosmetic pencil therein is tightly and hermetically assembled inside a container body, and a sealing rubber provided at an insert cap of an upper cap is brought into tight and hermetic contact with an upper end of the container body, thereby achieving very excellent airtightness. Thus, it is possible to preserve the quality of the cosmetic pencil.

In other words, by a double airtight structure of the upper cap and the tube, when storing and carrying the cosmetic pencil, it is possible to prevent moisture and fragrance as well as the original ingredients of the cosmetic pencil from being evaporated. Further, it is possible to prevent the cosmetic pencil from being hardened, contaminated, and deteriorated due to air introduced into the container body by interrupting inflow of air from outside.

Further, the present invention can provide excellent airtightness even if the sealing rubber provided at the insert cap of the upper cap or the expanded portion formed at the tube of the holder is selectively used. Thus, it is possible to prevent deterioration, contamination, and hardening of the cosmetic pencil during storing and carrying.

DESCRIPTION OF DRAWINGS

FIG. 1 is an external perspective view showing a cosmetic-pencil container according to the present invention.

FIG. 2 is an exploded perspective view of FIG. 1.

FIG. 3 is an assembled cross-sectional view showing the cosmetic-pencil container according to the present invention.

FIG. 4 is an enlarged view showing a portion "A" in FIG. 3.

FIG. 5 is an enlarged view showing a portion "B" in FIG. 3.

FIG. 6 is a partially cutaway perspective view showing a composition of a container body of the cosmetic-pencil container according to the present invention.

FIG. 7 is a front cross-sectional view showing the cosmetic-pencil container according to the present invention in use.

MODE FOR INVENTION

Hereinbelow, exemplary embodiments of the present invention will be described in detail with reference to the accompanying drawings.

As shown in FIGS. 1 to 6, the airtight cosmetic-pencil container of the present invention comprises a container body 10, a lower body 20, an upper cap 30, and a holder 40.

The container body 10 comprises a cylindrical body unit 11. The body unit 11 is provided at an upper outer surface thereof with a threaded portion 12*a* formed on a coupling step 12 to which the upper cap 30 is coupled, such that the upper cap 30 is coupled to the threaded portion 12*a* by screw-type engagement, and at a lower inner surface with a ring-shaped engagement groove 14.

The lower body 20 is coupled to the container body 10 by inserting an upper coupling portion 21 into a lower portion of the container body 10. Here, the upper coupling portion 21 is provided with a ring-shaped engagement protrusion 24 protruding on an outer surface thereof, such that the ring-shaped engagement protrusion 24 is fitted into the ring-shaped coupling groove 14 formed on the inner surface of the lower body 20, whereby the lower body 20 can be rotatable while being prevented from being separated.

Further, the lower body 20 is provided with an assembly bar 25 protruding at an upper portion thereof.

The upper cap 30 is coupled with an insert cap 31 at an inner surface thereof, and a sealing rubber 33 is fitted into a lower recess 31*a* of the insert cap 31. The sealing rubber 33 includes a cap-shaped cavity 33*a* formed to be open at a lower side thereof, and a flange 33*b* formed around an outer lower end of the sealing rubber 33 and surrounding a lower end of the insert cap 31, such that when the upper cap 30 is coupled to the container body 10, a lower end of the flange 33*b* is in close contact with an upper end 12*b* of the container body 10, and thus airtightness is secured therebetween.

Here, the flange 33*b* secures a contact surface larger than a thickness of the sealing rubber 33 such that the flange 33*b* is in close contact with the upper end 12*b* of the container body 10 with a large area, and is closely interposed between the insert cap 31 and the upper end 12*b* of the container body 10 such that when the upper cap 30 is coupled to the container body 10, the flange 33*b* presses the upper end 12*b* of the container body 10 to be in closer contact therewith.

Further, the insert cap 31 has a substantially H-shaped cross-section, and is supported at a lower outer side thereof by a support step 32 of an inner circumferential surface of the upper cap 30, such that the insert cap 31 is prevented from being separated.

The holder 40 is provided at an upper portion thereof with a tube 41 into which a cosmetic pencil 2 is inserted, and at a lower portion thereof with a screw rod 45 rotating up and down by being spirally engaged with a screw guide portion 15 centrally provided in the container body 10, wherein they are formed integrally with each other as shown in the drawing or may be assembled together.

The tube 41 is provided with an expanded portion 42 formed to gradually widen outward to an upper end thereof, such that an outer diameter of the expanded portion 42 is larger than an inner diameter of the coupling hole 11*a* of the container body 10. Accordingly, the expanded portion 42 is closely and elastically in contact with an inner circumferential surface of the coupling hole 11*a* of the container body 10, thereby securing airtightness therebetween.

In other words, an upper portion of the cosmetic pencil 2 is hermetically sealed by the sealing rubber 33 being coupled to the inner surface of the upper cap 30, and a lower portion thereof is hermetically sealed by the expanded portion 42 of the tube 41. Thus, when the cosmetic pencil is stored and carried, it is possible to prevent moisture, fragrances, and original ingredients of the cosmetic pencil 2 from being evaporated, and to prevent inflow of outside air, thereby preventing hardening, contamination, and deterioration of the cosmetic pencil 2.

Particularly, in the present invention, the coupling hole 11*a* of the container body 10 is hermetically sealed through the expanded portion 42 of the tube 41 being in close contact with the inner circumferential surface of the coupling hole 11*a* of the container body 10. Thus, as inflow of outside air into the interior of the container body 10 is prevented even when the upper cap 30 is opened, it is possible to prevent the cosmetic pencil 2 from being dried and hardened by the air flowing into the interior of the container body 10 even when the upper cap 30 is closed.

Further, the tube 41 is provided with a support protrusion 43 protruding on a lower outer surface of the tube 41, and supporting the holder 40 by being in close contact with the inner circumferential surface of the coupling hole 11*a* of the container body 10 such that the holder 40 is prevented from being positionally deviated.

The screw rod 45 is provided at a lower side thereof with an assembly hole 46 formed correspondingly to the assembly bar 25 of the lower body 20, and into which the assembly bar 25 is inserted, such that the screw rod 45 is rotated in conjunction with rotation of the lower body 20.

Herein, the assembly bar 25 of the lower body 20 and the assembly hole 46 of the screw rod 45 may be formed to have a polygonal cross-section corresponding to each other, such that the assembly bar 25 and the assembly hole 46 are integrally rotated with each other.

Reference numeral 47 denotes a tension locking piece provided at a lower end of the screw rod 45 and locking the screw rod 45 such that the screw rod 45 is prevented from being separated from the screw guide portion 15 in the container body 10.

Hereinafter, the operation and action of the present invention configured as described above will be described.

When the cosmetic pencil 2 of present invention is to be used, the container body 10 is opened by unscrewing the upper cap 30 from the upper portion of the container body 10.

Then, by holding the container body 10 and rotating the lower body 20 coupled to the lower portion of the container body 10, the holder 40 is rotated in conjunction with the lower body 20 by the assembly bar 25 of the upper portion of the lower body 20, the assembly bar 25 being inserted into the assembly hole 46.

Here, the assembly hole 46 of the holder 40 and the assembly bar 25 of the lower body 20 are formed to have a polygonal cross-section corresponding to each other, such that they are integrally rotated with each other.

As the holder 40 is rotated, the screw rod 45 of the holder 4 is spirally engaged with the screw guide portion 15 provided at the center inside the container body 10 and is rotated up, whereby the cosmetic pencil 2 inserted into the tube 41 provided at the upper portion of the container body 10 is extruded upward to be used.

In this process, the tube 41 provided at the upper portion of the holder 40 is lifted and lowered together with the expanded portion 42 being provided at the upper portion thereof and being closely and elastically in contact with the coupling hole 11*a* in the container body 10, while being vertically supported by the support protrusion 43 in close contact with the inner circumferential surface of the coupling hole 11*a* in the container body 10. Thus, the holder 40 can be prevented from being positionally deviated in the left and right direction and the cosmetic pencil 2 of the upper portion of the holder 40 can be fixedly supported. Thus, it is possible to efficiently use the cosmetic pencil 2.

When a user wants to store and carry the cosmetic pencil 2 after using the same, the lower body 20 coupled to the lower portion of the container body 10 is rotated in a reverse direction to lower the holder 40 to an original position. Then, the upper cap 30 is screwed on the upper portion of the container body 10 so as to be hermetically sealed.

Here, the coupling hole 11*a* inside the container body 10 secures airtightness by the expanded portion 42 formed at the upper portion of the tube 41 provided at the upper portion of the holder 40.

Since the expanded portion 42 has an outer diameter larger than the inner diameter of the coupling hole 11*a* of the container body 10, the expanded portion 42 is closely and elastically in contact with the inner circumferential surface of the coupling hole 11*a* of the container body 10 while being pressed against the inner circumferential surface of the coupling hole 11*a*, thereby functioning as a piston during lifting and lowering operation of the tube 41. Thus, it is possible to provide excellent airtightness.

Further, the sealing rubber 33 is coupled to the lower portion of the insert cap 31 inserted in the upper cap 30, whereby it is possible to ensure airtightness of the upper portion of the container body 10.

The flange 33*b* formed around the lower end of the sealing rubber 33 is in close contact with the upper end 12*b* of the container body 10. Here, since the flange 33*b* of the sealing rubber 33 is in close contact with the upper end 12*b* of the container body 10 with the large area by securing the contact surface wider than the thickness of the sealing rubber 33, and is closely interposed between the lower end of the insert cap 31 and the upper end 12*b* of the container body, the upper end 12*b* of the container body is pressed to be in closer contact with the flange 33*b* when the upper cap is coupled to the container body 10. Thus, it is possible to ensure excellent airtightness.

In other words, when the upper cap 30 is screwed on the container body 10 for storing and carrying the cosmetic pencil 2, the upper portion of the container body 10 is tightly pressurized and hermetically sealed by the sealing rubber 33 being coupled to the inner surface of the upper cap 30, and the interior of the container body 10 is hermetically sealed by the expanded portion 42 of the tube 41. Thus, it is possible to prevent moisture, fragrances, and original ingredients of the cosmetic pencil 2 from being evaporated, and to block the inflow of outside air, thereby more efficiently preventing the cosmetic pencil 2 from being hardened, contaminated, and deteriorated.

Meanwhile, according to the present invention, by selectively using the sealing rubber 33 provided at the insert cap 31 of the upper cap 30, or the expanded portion 42 formed at the tube 41 of the holder 40, the upper end 12*b* of the container body 10 is hermetically sealed or air is prevented from being introduced into the coupling hole 11*a*. Thus, it is possible to prevent deterioration, contamination, and hardening of the cosmetic pencil during storing and carrying.

Although a preferred embodiment of the present invention has been described for illustrative purposes, those skilled in the art will appreciate that various modifications, additions and substitutions are possible, without departing from the scope and spirit of the invention as disclosed in the accompanying claims. In the present invention, the cosmetic pencil is not a term but a concept that includes various stick-type cosmetics, such as stick-type lipstick or eyeliner.

DESCRIPTION OF THE REFERENCE NUMERALS IN THE DRAWINGS

| | |
|---|---|
| 10: container body | 11: body unit |
| 11a: coupling hole | 12: coupling step |
| 12a: threaded portion | 12b: upper end |

-continued

| | |
|---|---|
| 14: coupling groove | 15: screw guide portion |
| 20: lower body | 21: upper coupling portion |
| 24: coupling protrusion | 30: upper cap |
| 31: insert cap | 33: sealing rubber |
| 33a: cavity | 33b: flange |
| 40: holder | 41: tube |
| 42: expanded portion | 43: support protrusion |
| 45: screw rod | 46: assembly hole |

The invention claimed is:

1. An airtight cosmetic-pencil container, comprising:

a cylindrical container body (10) provided with a coupling hole (11*a*), and a coupling step (12) having an upper end (12*b*), with a threaded portion (12*a*) being formed on an outer circumferential surface of the coupling step (12);

a lower body (20) rotatably coupled to a lower portion of the container body (10);

an upper cap (30) openably coupled to the threaded portion (12*a*) formed on the coupling step (12) of the container body (10) by screw-type engagement; and a holder (40) inserted in the container body (10), and provided at an upper portion thereof with a tube (41), into which a cosmetic pencil (2) is inserted, and at a lower portion thereof with a screw rod (45) spirally engaged with a screw guide portion (15) provided inside the container body (10), and into which an assembly bar (25) provided at an upper portion of the lower body (20) is inserted, such that the screw rod (45) is rotated up and down in conjunction with rotation of the lower body (20), wherein the upper cap (30) includes an insert cap (31) and a sealing rubber (33) fitted into a lower recess (31*a*) of the insert cap (31), wherein the sealing rubber (33) is provided with a cap-shaped cavity (33*a*) formed to be open at a lower side thereof, and a flange (33*b*) formed around an outer lower end of the sealing rubber (33) and surrounding a lower end of the insert cap (31), such that when the upper cap (30) is closed to the container body (10) by screw-type engagement, a lower end of the flange (33*b*) of the sealing rubber (33) fitted in the insert cap (31) is in close and hermetic contact with an upper end (12*b*) of the container body (10), and the coupling hole (11*a*) of the container body (10) is closely and elastically blocked by an expanded portion (42) of the tube (41) inserted in the container body (10), such that when the upper cap (30) is coupled to the container body (10), external air is prevented from flowing into the upper cap (30) and into the container body (10).

2. The airtight cosmetic-pencil container of claim 1, wherein the expanded portion (42) of the tube (41) is formed to gradually widen outward, such that an outer diameter of the expanded portion (42) is larger than an inner diameter of the coupling hole (11*a*) of the container body (10).

3. The airtight cosmetic-pencil container of claim 1, wherein the tube (41) of the holder (40) is provided with a support protrusion (43) protruding on a lower outer surface of the tube (41), and being in close contact with an inner surface of the coupling hole (11*a*) of the container body (10) such that the holder (40) is prevented from being positionally deviated when being rotated up and down.

* * * * *